US010370611B2

(12) United States Patent
Muir et al.

(10) Patent No.: US 10,370,611 B2
(45) Date of Patent: Aug. 6, 2019

(54) LOW ASH LUBRICANT AND FUEL ADDITIVE COMPRISING ALKOXYLATED AMINE

(71) Applicant: Chemtura Corporation, Middlebury, CT (US)

(72) Inventors: Ron Muir, Stouffville, CA (US); John Louis DiFlavio, Mentor, OH (US); James-Jianjun Wei, Kitchener (CA)

(73) Assignee: LANXESS Solutions US Inc., Shelton, CT (US)

( * ) Notice: Subject to any disclaimer, the term of this patent is extended or adjusted under 35 U.S.C. 154(b) by 0 days.

(21) Appl. No.: 15/067,266

(22) Filed: Mar. 11, 2016

(65) Prior Publication Data

US 2016/0281014 A1 Sep. 29, 2016

Related U.S. Application Data

(60) Provisional application No. 62/137,141, filed on Mar. 23, 2015.

(51) Int. Cl.

| | |
|---|---|
| ***C10L 1/22*** | (2006.01) |
| ***C10L 10/06*** | (2006.01) |
| ***C10M 163/00*** | (2006.01) |
| ***C10L 1/24*** | (2006.01) |
| ***C10L 1/30*** | (2006.01) |
| ***C10L 10/04*** | (2006.01) |
| ***C10M 135/10*** | (2006.01) |
| ***C10M 159/12*** | (2006.01) |

(52) U.S. Cl.

CPC ..... *C10L 10/06* (2013.01); *C10L 1/24* (2013.01); *C10L 1/30* (2013.01); *C10L 10/04* (2013.01); *C10M 135/10* (2013.01); *C10M 159/12* (2013.01); *C10M 163/00* (2013.01); *C10L 1/2431* (2013.01); *C10L 2200/0259* (2013.01); *C10L 2200/0263* (2013.01); *C10M 2207/144* (2013.01); *C10M 2207/262* (2013.01); *C10M 2215/04* (2013.01); *C10M 2215/042* (2013.01); *C10M 2219/046* (2013.01); *C10M 2227/061* (2013.01); *C10N 2210/02* (2013.01); *C10N 2230/04* (2013.01); *C10N 2230/52* (2013.01); *C10N 2240/10* (2013.01); *C10N 2260/14* (2013.01)

(58) Field of Classification Search

CPC ..... C10M 129/50; C10M 129/54; C10M 2207/14

USPC ..... 508/189

See application file for complete search history.

(56) References Cited

U.S. PATENT DOCUMENTS

| | | | | |
|---|---|---|---|---|
| 2,497,521 | A | 2/1950 | Trautman | |
| 2,568,472 | A | 9/1951 | Trautman | |
| 3,293,463 | A | 12/1966 | Church | |
| 5,330,666 | A | 7/1994 | Habeeb | |
| 5,688,751 | A | 11/1997 | Cleveland et al. | |
| 5,854,182 | A | 12/1998 | Swami et al. | |
| 6,174,842 | B1 | 1/2001 | Gatto et al. | |
| 6,339,052 | B1 | 1/2002 | Dohhen et al. | |
| 7,691,794 | B2 | 4/2010 | Muir | |
| 2004/0102335 | A1 | 5/2004 | Carrick et al. | |
| 2007/0155631 | A1* | 7/2007 | Muir | C07F 5/04 508/185 |
| 2009/0156449 | A1* | 6/2009 | Rowland | C07C 209/24 508/557 |

OTHER PUBLICATIONS

Extended European Search Report dated May 19, 2016 from corresponding EP Application No. 16161689.1, 6 pages.

* cited by examiner

*Primary Examiner* — Prem C Singh
*Assistant Examiner* — Francis C Campanell

(57) ABSTRACT

A lubricating oil detergent composition comprises an over-based calcium sulfonate and a low ash detergent, which low ash detergent is metal free and comprises the reaction product of an acidic organic compound such as an alkylated salicylic acid, a boron compound and an amine component.

12 Claims, No Drawings

LOW ASH LUBRICANT AND FUEL ADDITIVE COMPRISING ALKOXYLATED AMINE

This application claims benefit under 35 USC 119(e) of U.S. Prov. Appl. No. 62/137,141 filed on Mar. 23, 2015, the disclosure of which is hereby incorporated by reference.

Provided is a detergent composition that exhibits excellent detergency in lubricating oil compositions, e.g., marine cylinder oil, said detergent composition comprising an overbased calcium sulfonate and a metal free low ash detergent comprising the reaction product of at least two of an acidic organic compound, a boron compound and an amine component comprising one or more amine, for example, the reaction product of an alkylated salicylic acid, a boron compound and one or more amine.

BACKGROUND OF THE INVENTION

Detergents are necessary components of engine oils for both gasoline and diesel engines. Incomplete combustion of the fuel produces soot that can lead to sludge deposits, as well as carbon and varnish deposits. In the case of diesel fuel, residual sulfur in the fuel burns in the combustion chamber to produce sulfur derived acids. These acids produce corrosion and wear in the engine, and accelerate the degradation of the oil. Neutral and overbased detergents are added to engine oils to neutralize these acidic compounds, thereby preventing the formation of harmful engine deposits and dramatically increasing engine life.

Metal detergents represent a major source of ash in formulated engine oils. Alkaline earth sulfonates, phenates and salicylates are typically used in modern engine oils to provide detergency and alkaline reserve. Low metal detergents are desirable for reducing ash and reducing sulfur is desirable for environmental reasons among others. Phenates often used in lubricating oil typically contain sulfur and reducing or eliminating their use is also desirable.

U.S. Pat. No. 5,330,666 discloses a lubricant oil composition useful for reducing friction in an internal combustion engine which comprises a lubricating oil basestock and an alkoxylated amine salt of a hydrocarbylsalicylic acid.

U.S. Pat. No. 5,688,751 discloses that two-stroke cycle engines can be effectively lubricated by supplying to the engine a mixture of an oil of lubricating viscosity and a hydrocarbyl-substituted hydroxyaromatic carboxylic acid or an ester, unsubstituted amide, hydrocarbyl-substituted amide, ammonium salt, hydrocarbylamine salt, or monovalent metal salt thereof in an amount suitable to reduce piston deposits in said engine. The mixture supplied to the engine contains less than 0.06 percent by weight of divalent metals.

U.S. Pat. No. 5,854,182 discloses dispersible magnesium borate overbased metallic detergent with an extremely fine particle prepared by reacting a neutral sulphonate of an alkaline earth metal with magnesium alkoxide and boric acid under anhydrous conditions in the presence of a dilution solvent followed by distillation to remove alcohol and part of dilution solvent, cooling the reaction mixture and filtering.

U.S. Pat. No. 6,174,842 discloses a lubricating oil composition that contains from about 50 to 1000 parts per million of molybdenum from an oil-soluble molybdenum compound that is substantially free of reactive sulfur, about 1,000 to 20,000 parts per million of a diarylamine, and about 2,000 to 40,000 parts per million of a phenate to reduce oxidation and improve deposit control.

U.S. Pat. No. 6,339,052 discloses a lubricating oil composition for gasoline and diesel internal combustion engines comprising an oil of lubricating viscosity; from 0.1 to 20.0% w/w of a sulfurized, overbased calcium phenate detergent derived from distilled, hydrogenated cashew nut shell liquid; and from 0.1 to 10.0% w/w of an amine salt of phosphorodithioic acid derived from cashew nut shell liquid.

U.S. Pat. Nos. 2,497,521 and 2,568,472 disclose oil compositions comprising an amine salt of a compound formed from boric acid and a certain hydroxy carboxylic acid. U.S. Pat. No. 3,239,463 discloses a tertiary alkyl primary amine salt of a tetra-covalent boron acid as an additive for lubricating oil. The tetra-covalent boron acid is prepared by reacting boric acid with a polyhydroxy compound or hydroxycarboxylic acid, e.g., salicylic acid which is then stabilized by formation of the amine salt.

U.S. Pat. No. 7,691,794, incorporated herein by reference, discloses the reaction products of an acidic organic compound, a boron compound and an alkoxylated amine and/or an alkoxylated amide, and fuel and lubricant compositions comprising these reaction products.

There is still a need to lower the amounts of sulfur, phosphorus and ash in lubricant formulations. It has been found that the combination of certain low ash detergents with commercially available overbased calcium sulfonates provides excellent lubricant detergency while eliminating the need for phenates and reducing the levels of ash, phosphorus and sulfur.

SUMMARY OF THE INVENTION

The invention provides a detergent composition comprising an overbased calcium sulfonate and a low ash detergent, e.g., a detergent comprising the reaction product of an acidic organic compound such as an alkylated salicylic acid, a boron compound and an amine component; the reaction product of an alkylated salicylic acid and a boron compound; or the reaction product of a boron compound and an amine component, exhibits excellent detergency in lubricating oil compositions, e.g., marine cylinder oil. For example, the detergent composition of the invention provides excellent detergency and cleanliness to an oil of lubricating viscosity when evaluated using the panel coker test. For example, in many embodiments of the invention the detergent composition comprises from 1 to 20 wt % low ash detergent based on the combined weight of the low ash detergent and overbased calcium sulfonate, for example 1 to 10 wt %, and in some embodiment 2-8% low ash detergent. By using the detergent composition of the invention one can completely replace the use of phenate by a small amount of low ash detergent.

Also provided is a lubricating oil comprising (a) an oil of lubricating viscosity; and (b) an effective amount of the detergent composition of the invention; a lubricating oil concentrate comprising about 15 wt % to about 90 wt % of the detergent composition of the invention; and a fuel composition comprising (a) a hydrocarbon fuel, e.g., a diesel fuel and (b) an effective amount of the detergent composition of the invention.

DESCRIPTION OF THE INVENTION

Overbased calcium sulfonates useful in the inventive detergent composition are well known and many are commercially available. The low ash detergent is metal free and comprises the reaction product of one or more acidic organic compound and one or more boron compound, the reaction product of one or more boron compound and an amine component comprising one or more amine, or the reaction product of one or more acidic organic compound, one or more boron compound and an amine component comprising one or more amine. In many embodiments, the acidic organic compounds of the low ash detergents are carboxylic acids, e.g., a salicylic acid. The amines useful in the invention are not particularly limited; in some embodiments the amines are selected from ethoxylated amines, polyamines and polymeric amines and in some embodiments the amine component may further comprise and alkoxylated amide.

Typically, the low ash detergent comprises the reaction product of one or more carboxylic acid, one or more boron compound and an amine component and contains no metals, phosphorus or sulfur. The low ash detergent of the invention often has a higher TBN than many similar materials.

The detergent composition of the invention exhibits excellent activity in lubricating oils, for example marine cylinder oils, and hydrocarbon fuels, for example diesel fuels. The detergent composition of the invention one can be used with or without other common lubricant additives, including other active detergents, but in many embodiments no other detergent is needed. The low ash detergent composition of the invention does not typically comprise a phenate and in particular embodiments, there is no phenate in the lubricant or fuel composition comprising the detergent composition of the invention.

In one embodiment the detergent composition is added to a lubricant base oil at a concentration commonly encountered in finished commercial lubricants, e.g., from about 0.1 wt % to about 15 wt %, based on the total weight of the lubricating oil composition, e.g., from about 0.1 wt % to about 10 wt %, e.g., from about 0.5 wt. % to about 5 wt. %, and in some embodiments from about 2 wt % to about 8 wt %. The lubricating oil composition of this embodiment may also comprise other common additives for lubricants.

In another embodiment, the detergent composition is added to a lubricant base oil at a higher concentration to form a concentrate or master batch, e.g., from about 15 wt % to about 90 wt %, based on the total weight of the lubricating oil composition, e.g., from about 20 wt % to about 70 wt % and in some embodiments from about 25 or 30 wt % to about 50 or 60 wt %. The lubricating oil composition of this embodiment may also comprise other common additives for lubricants.

The low ash detergent of the invention is typically formed by a process comprising first mixing one or more acidic organic compounds, e.g., carboxylic acids, with one or more boron compounds, often selected from boric acid and trialkyl borates, and then adding the amine component.

Suitable acidic organic compounds include, but are not limited to, mono-alkyl substituted salicylic acids, di-substituted salicylic acids, oil soluble hydroxy carboxylic acids, salicylic acid calixarenes, and the like and combinations thereof.

For example, substituted salicylic acids are either commercially available or may be prepared by methods known in the art, and can be represented by the structure of formula I:

(I)

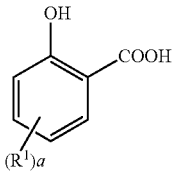

wherein $R^1$ is independently a hydrocarbyl group having from 1 to about 30 carbon atoms, and a is an integer of 1 or 2. The term "hydrocarbyl" includes hydrocarbon as well as substantially hydrocarbon groups. "Substantially hydrocarbon" describes groups that contain heteroatom substituents that do not alter the predominantly hydrocarbon nature of the group. Representative examples of hydrocarbyl groups for use herein include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which do not alter the predominantly hydrocarbon nature of the substituent, e.g., halo, hydroxy, nitro, nitroso, etc.; and (3) heteroatom substituents, i.e., substituents that will, while having a predominantly hydrocarbon character, contain an atom other than carbon present in a ring or chain otherwise composed of carbon atoms, e.g., alkoxy. Suitable heteroatoms will be apparent to those of ordinary skill in the art and include, for example, oxygen, nitrogen, and such substituents as, e.g., pyridyl, furyl, imidazolyl, etc. Generally no more than about 2, and often no more than one, hetero substituent will be present for every ten carbon atoms in the hydrocarbyl group.

In most embodiments there will be no such heteroatom substituents in the hydrocarbyl group, i.e., the hydrocarbyl group is purely hydrocarbon.

Examples of $R^1$ in formula I above include, but are not limited to:

unsubstituted phenyl;

phenyl substituted with one or more alkyl groups, e.g., methyl, ethyl, propyl, butyl, pentyl, hexyl, heptyl, octyl, nonyl, decyl, isomers of the foregoing, and the like; phenyl substituted with one or more alkoxy groups, such as methoxy, ethoxy, propoxy, butoxy, pentoxy, hexoxy, heptoxy, octoxy, nonoxy, decoxy, isomers of the foregoing, and the like;

phenyl substituted with one or more alkyl amino or aryl amino groups;

naphthyl and alkyl substituted naphthyl;

straight chain or branched chain alkyl or alkenyl groups containing from one to fifty carbon atoms, including, but not limited to, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, isomers of the foregoing, and the like; and cyclic alkyl groups, such as cyclopentyl, cyclohexyl, cycloheptyl, cyclooctyl, and cyclododecyl.

It will be noted that these salicylic acid derivatives can be either monosubstituted or disubstituted, i.e., when a in the formula equals 1 or 2, respectively.

Salicylic acid calixarenes such as those described in can be used as the acid compounds in the reaction products of the present invention. Such calixarenes include, but are not limited to, cyclic compounds comprising m units of a salicylic acid of formula IIa:

(IIa)

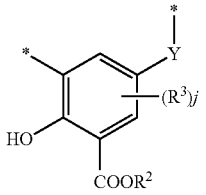

and n units of a phenol of formula IIb:

(IIb)

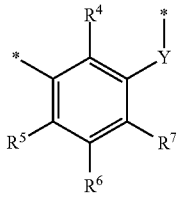

which are joined together to form a ring, wherein each Y is independently a divalent bridging group; $R^2$ is independently hydrogen or an alkyl group of 1 to 6 carbon atoms; $R^3$ is independently hydrogen or an alkyl group of 1 to 60 carbon atoms; and j is 1 or 2; either $R^4$ is hydroxy and $R^5$ and $R^7$ are independently hydrogen, hydrocarbyl or hetero-substituted hydrocarbyl, or $R^5$ and $R^7$ are hydroxyl and $R^4$ is either hydrogen, hydrocarbyl or hetero-substituted hydrocarbyl; $R^6$ is independently hydrogen, a hydrocarbyl or a hetero-substituted hydrocarbyl group; m is from 1 to 8; n is at least 3, and m+n is 4 to 20.

When more than one salicylic acid unit is present in the ring (i.e., m>1), the salicylic acid units (formula IIa) and phenol units (formula IIb) are distributed randomly, although this does not exclude the possibility that in some rings there may be several salicylic acid units joined together in a row.

Each Y may independently be represented by the formula $(CHR^8)_d$ in which $R^8$ is either hydrogen or hydrocarbyl and d is an integer which is at least 1. In one embodiment, $R^8$ contains 1 to 6 carbon atoms, and in one embodiment it is methyl. In another embodiment, d is from 1 to 4. For convenience, these compounds are sometimes referred to as "salixarenes" and their metal salts as "salixarates".

In one embodiment, Y is $CH_2$; $R^4$ is hydroxyl; $R^5$ and $R^7$ are independently either hydrogen, hydrocarbyl or hetero-substituted hydrocarbyl; $R^6$ is either hydrocarbyl or hetero-substituted hydrocarbyl; $R^2$ is H; $R^3$ is an alkyl group of 6 to about 50 carbon atoms, for example, 4 to about 40 carbon atoms, such as 6 to about 25 carbon atoms; and m+n has a value of at least 5, typically at least 6, for example at least 8, wherein m is 1 or 2, e.g., 1.

In another embodiment, $R^5$ and $R^7$ are hydrogen; $R^6$ is hydrocarbyl, e.g., alkyl of greater than 4 carbon atoms, often greater than 9 carbon atoms; $R^3$ is hydrogen; m+n is from 6 to 12; and m is 1 or 2.

Generally, calixarenes having a substituent hydroxyl group or groups include homocalixarenes, oxacalixarenes, homooxacalixarenes, and heterocalixarenes.

Other acids can also be used as the acid compounds of the present invention. Examples of such acids include, but are not limited to, compounds of the formula:

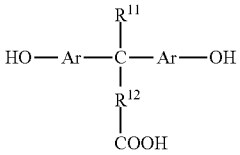

wherein $R^{11}$ is a hydrocarbon or halogen, $R^{12}$ is a hydrocarbon, and Ar is a substituted or unsubstituted aryl. For example, acids of the formula

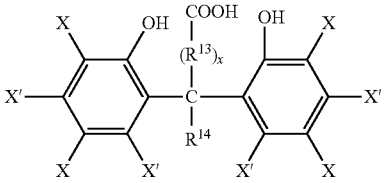

wherein X and X' are independently hydrogen, hydrocarbyl, and halogen, $R^{13}$ is polymethylene or branched or unbranched alkylene, x is 0 or 1 and $R^{14}$ is hydrogen or hydrocarbyl.

Other useful acids include compounds of formula:

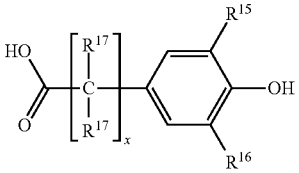

wherein $R^{15}$ and $R^{16}$ independently are hydrogen, a hydrocarbyl group containing 1 to about 18 carbon atoms, or tertiary alkyl or aralkyl groups containing 4 to 8 carbon atoms with the proviso that only one of $R^{15}$ and $R^{16}$ can be hydrogen; each $R^{17}$ independently are hydrogen, a hydrocarbyl group, aralkyl groups, and cycloalkyl groups, and x is 0 to 24.

Oil soluble hydroxy carboxylic acids including, but not limited to, 12-hydroxy stearic acid, alpha hydroxy carboxylic acids and the like, can also be employed as the acidic compound of the present invention.

Typically, the acidic organic compound is selected from the group consisting of alkyl substituted salicylic acids, di-substituted salicylic acids, oil soluble hydroxy carboxylic acids, salicylic acid calixarenes, e.g., monoalkyl substituted salicylic acids or dialkyl substituted salicylic acids.

The boron compound can be, for example, boric acid, a trialkyl borate in which the alkyl groups comprise from 1 to 4 carbon atoms each, alkyl boric acid, dialkyl boric acid, boric oxide, boric acid complex, cycloalkyl boric acid, aryl boric acid, dicycloalkyl boric acid, diaryl boric acid, or substitution products of these with alkoxy, alkyl, and/or alkyl groups, and the like. Typically, the boron compound is boric acid.

In some embodiments the amine component of the low ash detergent will comprise a polyamine, i.e., an amine comprising more than one amine functionality. For example, the polyamine may be a polymer comprising at least 3, 4, 5, 6 or more, typically at least 4, amine containing monomer units, e.g., 12 monomer units or more, e.g., from 20 to 50,000 monomer units, such as poly-alkyleneamines, poly-oxyalkyleneamines and poly-alkylphenoxyaminoalkanes. Commercial examples of useful polyamines include, for example, Jeffamines, poly ethethylene imine, poly propylene imine, etc.

In some embodiments the amine component of the low ash detergent will comprise an alkoxylated amine, for examples, those described in U.S. Pat. No. 7,691,794, already incorporated herein by reference. That is the alkoxylated amines can include saturated or unsaturated mono or polyalkoxylated alkylamines, e.g., dialkoxylated alkyl amines, saturated or unsaturated mono or polyalkoxylated arylamines and the like and mixtures thereof. As one skilled in the art will readily appreciate, the alkoxylated amines for use herein can be obtained from primary, secondary or tertiary amines. The term "monoalkoxylated" as used herein shall be understood to mean an alkoxy unit attached via an oxygen linkage to the rest of the molecule wherein the alkoxy unit can contain 1 to about 60 alkoxy radicals, e.g., from 1 to about 30 alkoxy radicals or from 1 to about 20 alkoxy radicals, in random or block sequences, and wherein each alkoxy radical can be the same or different, e.g., ethylene oxide-propylene oxide-ethylene oxide unit, ethylene oxide-ethylene oxide-ethylene oxide unit and the like. The term "polyalkoxylated" as used herein shall be understood to mean more than one alkoxy unit, e.g., a dialkoxylated unit, each attached via an oxygen linkage to the rest of the molecule wherein each alkoxy unit can contain 1 to about 60 alkoxy radicals, e.g., from 1 to about 30 alkoxy radicals or from 1 to about 20 alkoxy radicals, in random or block sequences, and wherein each alkoxy radical can be the same or different as described hereinabove.

In one embodiment, the alkoxylated amines include, but are not limited to, mono or polyethoxylated amines, mono or polyethoxylated fatty acid amines and the like and mixtures thereof.

In another embodiment, the alkoxylated amine includes an alkoxylated derivative of an alkanolamine, e.g., diethanolamine or of triethanolamine, or an alkoxylated derivative of a reaction product of an alkanolamine with a $C_4$-$C_{75}$ fatty acid ester. The fatty acid ester for use in forming the reaction product herein can be, for example, glycerol fatty acid esters, i.e., glycerides derived from natural sources such as, for example, beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil and the like, for example, coconut oil.

The glycerol fatty acid esters will contain from about $C_4$ to about $C_{75}$, for example, about $C_6$ to about $C_{24}$ fatty acid esters, i.e., several fatty acid moieties, the number and type varying with the source of the oil. Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Often the acid is saturated. Examples of unsaturated fatty acids include, myristoleic acid, palmitoleic acid, oleic acid, linolenic acid, and the like. Examples of saturated fatty acids include caproic acid, caprylic acid, capric acid, lauric acid, myristic acid, palmitic acid, stearic acid, arachidic acid, behenic acid, lignoceric acid, and the like.

Representative examples of suitable alkoxylated amines include:

(a) an alkoxylated amine represented by general formula:

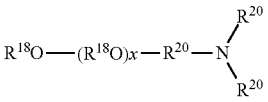

wherein $R^{18}$ is hydrogen or a substituted or unsubstituted hydrocarbyl having from 1 to about 30 carbon atom, e.g., from about 8 to about 30 carbon atoms; $R^{19}$ in each of the x ($R^{19}O$) groups is independently a straight or branched $C_2$-$C_4$ alkylene; $R^{20}$ is a bond or a substituted or unsubstituted hydrocarbylene having from 2 to about 6 carbon atoms; $R^{21}$ and $R^{22}$ are each independently hydrogen, substituted or unsubstituted hydrocarbyl having from 1 to about 30 carbon atoms, $—(R^{23})_n—(R^{19}O)_yR^{24}$, or $R^{21}$ and $R^{22}$ together with the nitrogen atom to which they are bonded are joined together to form a heterocyclic group; $R^{23}$ is substituted or unsubstituted hydrocarbylene containing from 1 to about 6 carbon atoms, $R^{24}$ is hydrogen or a linear or branched alkyl group having 1 to about 4 carbon atoms, n is 0 or 1, and x is an average number from 1 to about 60, for example, from 1 to about 30 and often from 1 to about 20. Suitable hydrocarbyl (hydrocarbylene) groups include, but are not limited to, linear or branched alkyl (alkylene), linear or branched alkenyl (alkenylene), linear or branched alkynyl (alkynylene), aryl (arylene), aralkyl (aralkylene) groups and the like. For example, $R^{18}$ is a linear or branched alkyl or linear or branched alkenyl group having from about 8 to about 25 carbon atoms, $R^{19}$ in each of the x ($R^{19}O$) groups is independently a straight or branched $C_2$-$C_4$ alkylene, $R^{21}$ and $R^{22}$ are each independently hydrogen or a linear or branched alkyl group having from 1 to about 6 carbon atoms, and x is an average number from 1 to about 30.

(b) an alkoxylated amine represented by general formula:

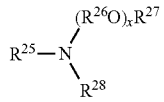

wherein $R^{25}$ is a substituted or unsubstituted hydrocarbyl having from 1 to about 30 carbon atoms, e.g., from about 8 to about 30 carbon atoms; $R^{26}$ in each of the x ($R^{26}O$) groups is independently a straight or branched $C_2$-$C_4$ alkylene; $R^{27}$ is hydrogen or a straight or branched alkyl group having from 1 to about 6 carbon atoms; $R^{28}$ is a substituted or unsubstituted hydrocarbyl having from 1 to about 30 carbon atoms, e.g., a linear or branched alkynyl, aryl, or aralkyl group having from 1 to about 30 carbon atoms, and x is an average number from 1 to about 60. For example, $R^{25}$ is a straight or branched alkyl, straight or branched alkenyl, straight or branched alkynyl, aryl, or aralkyl groups.

(c) a dialkoxylated amine represented by general formula:

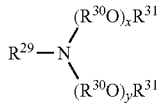

wherein $R^{29}$ is a linear or branched alkyl, linear or branched alkenyl, linear or branched alkynyl, aryl, or aralkyl group having from about 6 to about 30 carbon atoms, $R^{30}$ in each of the x ($R^{30}O$) and the y ($R^{30}O$) groups is independently a straight or branched $C_2$-$C_4$ alkylene, $R^{31}$ is independently hydrogen, or a linear or branched alkyl group having from 1 to about 4 carbon atoms and x and y are independently an average number from 1 to about 40. For example, $R^{29}$ is a straight or branched alkyl or straight or branched alkenyl group having from about 8 to about 30 carbon atoms, $R^{30}$ in each of the x ($R^{30}O$) and the y ($R^{30}O$) groups is independently a straight or branched $C_2$-$C_4$ alkylene, $R^{31}$ is independently hydrogen, methyl or ethyl, and x and y are independently an average number from 1 to about 20. Often $R^{29}$ is a linear or branched alkyl group having from about 8 to about 25 carbon atoms, $R^{30}$ in each of the x ($R^{30}O$) and the y($R^{36}O$) groups is independently ethylene or propylene, $R^{31}$ is independently hydrogen or methyl, and x and y are independently an average number from 1 to about 10. Typically $R^{29}$ is a linear or branched alkyl group having from about 8 to about 22 carbon atoms, $R^{30}$ in each of the x ($R^{30}O$) and the y ($R^{30}O$) groups is independently ethylene or propylene, $R^{31}$ is independently hydrogen or methyl, and x and y are independently an average number from 1 to about 5.

Useful commercially available alkoxylated amines include those available from Akzo Nobel under the ETHOMEEN tradename, e.g., ETHOMEEN ethoxylated amine C/12, C/15, C/20, C/25, SV/12, SV/15, T/12, T/15, T/20 and T/25.

In some particular embodiments the amine component may further comprise an alkoxylated amide derived from one of the alkoxylated amines. In some embodiments an alkoxylated amide is excluded from the reaction.

The reaction of the boron compound with the acidic compound and amine component of the present invention can be effected in any suitable manner. For example, the reaction can be conducted by first combining the one or more acidic compound and one or more boron compound in the desired ratio and in the presence of a suitable solvent, e.g., naphtha and polar solvents such as water and methanol. After a sufficient time, the boron compound dissolves whereupon the amine component is added slowly to effect neutralization and formation of desired reaction product. If desired, a diluting oil can be added as needed to control viscosity, particularly during removal of solvents by distillation. The reaction can typically be conducted by maintaining the reactants at a temperature of from about 20° C. to about 100° C., for example from about 50° C. to about 75° C., often for a time period ranging from about 1 to about 4 hours.

If desired, the reaction can be carried out in an alcohol, e.g., aliphatic and aromatic alcohols, which can be included in the reaction charge. Suitable aliphatic alcohols include, but are not limited to, methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, isomers thereof, and the like. Suitable aromatic alcohols include, but are not limited to, phenol, cresol, xylenol, and the like. The alcohol or aromatic phenol moiety may be substituted with alkoxy groups.

It will be understood by those skilled in the art that the foregoing reaction product will contain a complex mixture of compounds. The reaction product mixture need not be separated to isolate one or more specific components. Accordingly, the reaction product mixture can be employed as is in the lubrication oil composition or fuel composition of the present invention.

The reaction products of the present invention are useful as additives in lubricating oil compositions. Generally, the lubricating oil compositions of this invention include as a first component an oil of lubricating viscosity. The oil of lubricating viscosity for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, e.g., automatic transmission fluids, etc., turbine lubricants, trunk piston engine oils, compressor lubricants, metalworking lubricants, and other lubricating oil and grease compositions. Additionally, the oil of lubricating viscosity for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the oil of lubricating viscosity is dependent upon the application. Accordingly, the viscosity of an oil of lubricating viscosity for use herein will ordinarily range from about 2 to about 2000 centistokes (cSt) at 100° C. Generally, individually the oils used as engine oils will have a kinematic viscosity range at 100° C. of about 2 cSt to about 30 cSt, for example about 3 cSt to about 16 cSt, and often about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W; 10W-20, 10W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fisher-Tropsch process. For example, a suitable oil of lubricating viscosity is one that comprises little, if any, heavy fraction; e.g., little, if any, lube oil fraction of viscosity about 20 cSt or higher at 100° C.

The oil of lubricating viscosity may be derived from natural lubricating oils, synthetic lubricating oils or mixtures thereof. Suitable oils includes base stocks obtained by isomerization of synthetic wax and slack wax, as well as hydrocracked base stocks produced by hydrocracking (rather than solvent extracting) the aromatic and polar components of the crude. Suitable oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are generally used in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity, for example synthetic hydrocarbon oils that are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of about 1,000, diphenyl ether of polyethylene glycol having a molecular weight of about 500 to about 1000, diethyl ether of polypropylene glycol having a molecular weight of about 1,000 to about 1,500, etc.) or mono- and polycarboxylic esters thereof such as, for example, the acetic esters, mixed $C_3$-$C_8$ fatty acid esters, or the $C_{13}$oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The oil of lubricating viscosity may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The oil of lubricating viscosity for use in the lubricating oil compositions may be present in a major amount, e.g., an amount of greater than 50 wt. %, e.g., greater than about 70 wt. %, often from about 80 to about 99.5 wt. % and in many embodiments from about 85 to about 98 wt. %, based on the total weight of the composition.

The detergent composition of the present invention can be used as a complete or partial replacement for commercially available detergents currently used in lubricant formulations and can be in combination with other additives typically found in motor oils. Generally, the reaction products of the present invention will be present in the lubricating oil compositions in an effective amount ranging from about 0.1 to about 15 wt. %, e.g., from about 0.1 wt. % to about 10% wt. % and often from about 0.5 wt. % to about 5 wt. %, based on the total weight of the lubricating oil composition.

If desired, other additives can be admixed with the foregoing lubricating oil compositions to enhance performance. When used in combination with other types of antioxidants or additives used in oil formulations, synergistic and/or additive performance effects may be obtained with respect to improved antioxidancy, antiwear, frictional and detergency and high temperature engine deposit properties. Such additives are well known. The lubricating oil additives typically found in lubricating oils are, for example, dispersants, detergents, corrosion/rust inhibitors, antioxidants, anti-wear agents, anti-foamants, friction modifiers, seal swell agents, emulsifiers, VI improvers, pour point depressants, and the like. The additives can be employed in the lubricating oil compositions at the usual levels in accordance with well known practice.

Examples of dispersants include polyisobutylene succinimides, polyisobutylene succinate esters, Mannich Base ashless dispersants, and the like. Examples of detergents include metallic and ashless alkyl phenates, metallic and ashless alkyl sulfonates, metallic and ashless alkyl salicylates, metallic and ashless saligenin derivatives, and the like.

Examples of other antioxidants include alkylated diphenylamines, N-alkylated phenylenediamines, phenyl-naphthylamine, alkylated phenyl-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like.

Examples of anti-wear additives that can be used in combination with the additives of the present invention include organo borates, organo phosphites, organo phosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like.

An example of an anti-foam agent is polysiloxane, and the like. Examples of rust inhibitors are polyoxyalkylene polyol, benzotriazole derivatives, and the like. Examples of VI improvers include olefin copolymers and dispersant olefin copolymers, and the like. An example of a pour point depressant is polymethacrylate, and the like.

The lubricating oil compositions of the present invention, when they contain these additives, are typically blended into a base oil in amounts such that the additives therein are effective to provide their normal attendant functions.

When other additives are employed, it may be desirable, although not necessary, to prepare additive concentrates comprising concentrated solutions or dispersions of one or more of the reaction products of the present invention, together with one or more other additives whereby several additives can be added simultaneously to the base oil to form the lubricating oil composition. Dissolution of the additive concentrate into the lubricating oil can be facilitated by, for example, solvents and by mixing accompanied by mild heating, but this is not essential.

The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, e.g., from about 15 to about 75 percent, and often from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricating oil compositions of the present invention can contain the detergent composition in a concentration ranging from about 0.05 to about 30 weight percent. A concentration range for the additives ranging from about 0.1 to about 10 weight percent based on the total weight of the oil composition is common. A typical concentration range is from about 0.2 to about 5 weight percent. In one embodiment, oil concentrates of the additives can contain from about 1 to about 75 weight percent of the additive in a carrier or diluent oil of lubricating oil viscosity.

The lubricating oil compositions containing the detergent composition of the invention exhibit enhanced deposit protection in addition to oxidation-corrosion protection. The lubricating oil compositions can also provide such protection while having relatively low levels of phosphorous, e.g., less than about 0.1%, e.g., less than about 0.08%, often less than about 0.05% by weight. Accordingly, the lubricating oil compositions of the present invention can be more environmentally desirable than the higher phosphorous lubricating oil compositions generally used in internal combustion engines because they facilitate longer catalytic converter life and activity while also providing the desired high deposit protection. This is due to the substantial absence of additives containing phosphorus compounds in these lubricating oil compositions. The reaction product for use herein may also protect against oxidation both in the presence of transition metals such as, for example, iron (Fe) and copper (Cu), etc., as well as in a metal free environment.

The detergent composition of the invention can also be useful as an additive for fuel compositions. The fuel can be any fuel, e.g., motor fuels such as diesel fuel and gasoline, kerosene, jet fuels, alcoholic fuels such as methanol or ethanol; marine bunker fuel, natural gas, home heating fuel or a mixture of any of the foregoing. When the fuel is diesel, such fuel generally boils above about 212° F. The diesel fuel can comprise atmospheric distillate or vacuum distillate, or a blend in any proportion of straight run and thermally and/or catalytically cracked distillates. Typically diesel fuels useful herein have a cetane number of at least 40, e.g., above 45, and often above 50. The diesel fuel can have such cetane numbers prior to the addition of any cetane improver. The cetane number of the fuel can be raised by the addition of a cetane improver.

When the fuel is gasoline, it can be derived from straight-chain naphtha, polymer gasoline, natural gasoline, catalytically cracked or thermally cracked hydrocarbons, catalytically reformed stocks, etc. It will be understood by one skilled in the art that gasoline fuels typically boil in the range of about 80-450° F. and can contain straight chain or branched chain paraffins, cycloparaffins, olefins, aromatic hydrocarbons, and any mixture of these.

The proper concentration of the detergent composition of the present invention necessary to achieve the desired result in fuel compositions is dependent upon a variety of factors including, for example, the type of fuel used, the presence of other additives, etc. Generally, however, the detergent composition concentration of the reaction product of this invention in the base fuel can range from about 10 to about 5,000 parts per million and often from about 50 to about 1,000 parts per million per part of base fuel.

If desired, one or more additional fuel additives may be incorporated into the fuel composition of the present invention. Such additives for use in the fuel additive and fuel compositions herein can be any presently known or later-discovered additive used in formulating fuel compositions. The fuel additives include, but are not limited to, detergents, cetane improvers, octane improvers, friction modifiers, emission reducers, antioxidants, carrier fluids, metal deactivators, lead scavengers, rust inhibitors, bacteriostatic agents, corrosion inhibitors, antistatic additives, drag reducing agents, demulsifiers, dehazers, anti-icing additives, dispersants, combustion improvers and the like and mixtures thereof. A variety of the additives are known and commercially available. These additives, or their analogous compounds, can be employed for the preparation of the various fuel compositions herein. The additives may be employed in the fuel compositions at the usual levels in accordance with well known practice.

The additives described herein may also be formulated as a fuel concentrate, using an inert stable oleophilic organic solvent boiling in the range of about 150° F. to about 400° F. An aliphatic or an aromatic hydrocarbon solvent is preferred, e.g., solvents such as benzene, toluene, xylene or higher-boiling aromatics or aromatic thinners. Aliphatic alcohols of about 3 to 8 carbon atoms, e.g., isopropanol, isobutylcarbinol, n-butanol and the like, in combination with hydrocarbon solvents are also suitable for use with the fuel additive. In the fuel concentrate, the amount of the additive will be ordinarily be about 5 or more wt. % and generally not exceed about 70 wt. %, e.g., from about 5 wt. % to about 50 wt. %. Often from about 10 wt. % to about 25 wt. %, based on the total weight of the fuel composition.

EXAMPLES

Example 1

According to a process similar to that of Example 1 of U.S. Pat. No. 7,691,794, a low ash detergent with a TBN of 115 was prepared by mixing alkylate salicylic acid and boric acid followed by addition of ethoxylated tallow amine and heating.

Example 2

Example 1 was repeated using a different ratio of salicylic acid to ethoxylated tallow amine to obtain a low ash detergent with a TBN of 96.

A combination of overbased calcium sulfonate HYBASE C-402 (TBN ~410), and ~4-7 wt % of the low ash detergent of Example 1 or 2, based on the weight of the combination, was mixed in SAE 50 oil at 60° C. to prepare lubricant test samples for Panel Coker testing.

Example 3

8 TBN of the low ash detergent of Ex 1 mixed with 62 TBN of HYBASE C-402 overbased calcium sulfonate in SAE 50 oil.

Example 4

5 TBN of the low ash detergent of Ex 2 mixed with 65 TBN of HYBASE C-402 overbased calcium sulfonate in SAE 50 oil.

The detergency efficacy of crankcase oils can be assessed in terms of deposit forming tendency on a rectangular Al-steel panel in a Panel Coker test. In this test, 200 ml of the test sample is taken in sump and heated at 100° C. For a period of 4 hours, this heated oil is splashed by whiskers on the Al-steel panel, the temperature of which is maintained at 310° C. After completion of the test, any deposits on the panel are weighed. Data appears below.

| Sample | Deposits | Appearance |
|---|---|---|
| Ex 3 | 3 mg | Clean, slight varnish |
| Ex 4 | 9 mg | Clean, no varnish |

What is claimed:

1. A lubricant composition comprising:

at least 70 wt % of an oil of lubricating viscosity based on the weight of the lubricant composition, of an oil of lubricating viscosity and a detergent composition for lubricants and fuels, said detergent composition comprising an overbased calcium sulfonate having a TBN of about 410 and 4 to 7 wt % of a low ash detergent, based on the weight of the combination of overbased calcium sulfonate and low ash detergent, wherein the detergent composition contains no phenate, and the low ash detergent is the reaction product of:

a) one or more alkylated salicylic acids of formula I:

(I)

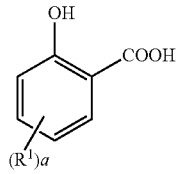

wherein $R^1$ is selected from the group consisting of dodecyl, tridecyl, tetradecyl, pentadecyl, hexadecyl, heptadecyl, octadecyl, nonadecyl, eicosyl and isomers thereof, and 'a' is an integer of 1 or 2;

b) boric acid; and c) ethoxylated tallow amine wherein the low ash detergent has a TBN of from 96 to 115 and contains no metals, phosphorus or sulfur, and the lubricant composition contains no phenate.

2. The lubricant composition according to claim 1 comprising from about 80 to about 99.5 wt. % of the oil of lubricating viscosity.

3. The lubricant composition according to claim 1 wherein the oil of lubricating viscosity is a marine cylinder oil.

4. The lubricant composition according to claim 1, which lubricant composition has a TBN of 70.

5. The lubricant composition according to claim 1 wherein R1 in formula I is selected from the group consisting of tetradecyl, pentadecyl, hexadecyl, heptadecyl, octadecyl and isomers thereof.

6. The lubricant composition according to claim 5 comprising from about 80 to about 99.5 wt. % of the oil of lubricating viscosity.

7. The lubricant composition according to claim 5 wherein the oil of lubricating viscosity is a marine cylinder oil.

8. The lubricant composition according to claim 5, which lubricant composition has a TBN of 70.

9. The lubricant composition according to claim 5 wherein R1 in formula I is selected from the group consisting of tetradecyl, hexadecyl, octadecyl and isomers thereof.

10. The lubricant composition according to claim 9 comprising from about 80 to about 99.5 wt. % of the oil of lubricating viscosity.

11. The lubricant composition according to claim 9 wherein the oil of lubricating viscosity is a marine cylinder oil.

12. The lubricant composition according to claim 9 which lubricant composition has a TBN of 70.

* * * * *